US009405209B2

(12) United States Patent
Hanano

(10) Patent No.: US 9,405,209 B2
(45) Date of Patent: Aug. 2, 2016

(54) IMAGE FORMING UNIT AND IMAGE FORMING APPARATUS PROVIDED WITH SAME

(71) Applicant: KYOCERA Document Solutions Inc., Osaka (JP)

(72) Inventor: Susumu Hanano, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 3 days.

(21) Appl. No.: 14/962,309

(22) Filed: Dec. 8, 2015

(65) Prior Publication Data

US 2016/0170322 A1 Jun. 16, 2016

(30) Foreign Application Priority Data

Dec. 12, 2014 (JP) ..... 2014-252467

(51) Int. Cl.
*G03G 15/02* (2006.01)

(52) U.S. Cl.
CPC ..... *G03G 15/0216* (2013.01)

(58) Field of Classification Search
USPC ..... 399/107, 110, 113, 115–117, 168, 174, 399/176
See application file for complete search history.

(56) References Cited

U.S. PATENT DOCUMENTS

2006/0120758 A1* 6/2006 Muto ..... G03G 15/0812 399/175
2011/0311274 A1* 12/2011 Ishii ..... G03G 21/1853 399/113

FOREIGN PATENT DOCUMENTS

JP H06-175424 A 6/1994

* cited by examiner

*Primary Examiner* — Hoan Tran

(57) ABSTRACT

An image forming unit includes: a photoconductive drum; a charging member extending in a direction along a rotary shaft of the photoconductive drum; and a holding member holding the charging member at a frame member. While held at the frame member with the holding member in between, the charging member is arranged in parallel to the photoconductive drum in contact with a circumferential surface of the photoconductive drum with their rotary shafts in parallel. The holding member and the frame member respectively have interference-preventing-shaped parts provided at a tip part of the holding member in a direction where the holding member is attached and at a position of the frame member receiving the holding member. The interference-preventing-shaped parts are capable of first making contact with each other upon attachment of the charging member to the frame member to thereby prevent interference between the holding member and the photoconductive drum.

8 Claims, 5 Drawing Sheets

IMAGE FORMING UNIT AND IMAGE FORMING APPARATUS PROVIDED WITH SAME

INCORPORATION BY REFERENCE

This application claims priority to Japanese Patent Application No. 2014-252467 filed on Dec. 12, 2014, the entire contents of which are incorporated by reference herein.

BACKGROUND

This disclosure relates to an image forming unit and an image forming apparatus provided with such an image forming unit.

In an image forming apparatus such as a copier, a photoconductive drum as a toner image carrier and a charging roller are arranged in a manner such as to rotate in contact with each other. For example, shown is a mechanism of driving the photoconductive drum and the charging roller while pressing the charging roller against the photoconductive drum to form a nip part. In this image forming apparatus, to form the nip part, the charging roller needs to be fitted to a frame member pivotably supporting the photoconductive drum.

SUMMARY

As one aspect of this disclosure, a technology obtained by further improving the technology described above will be suggested.

An image forming unit according to one aspect of this disclosure includes: a photoconductive drum, a charging member, and a holding member.

The photoconductive drum is pivotably supported at a frame member.

The charging member extends in a direction along a rotary shaft of the photoconductive drum and charges a circumferential surface of the photoconductive drum while making contact with the circumferential surface.

The holding member is provided in the charging member and holds the charging member at the frame member.

While held at the frame member with the holding member in between, the charging member is arranged in parallel to the photoconductive drum in contact with the circumferential surface of the photoconductive drum with a rotary shaft of the charging member and the rotary shaft of the photoconductive drum in parallel to each other.

The holding member and the frame member respectively have interference-preventing-shaped parts which is provided at a tip part of the holding member in a direction in which the holding member is attached and at a position of the frame member receiving the holding member. The interference-preventing-shaped parts are capable of first making contact with each other upon attachment of the charging member to the frame member with the holding member in between to thereby prevent interference between the holding member and the photoconductive drum.

DETAILED DESCRIPTION

Figure 1:
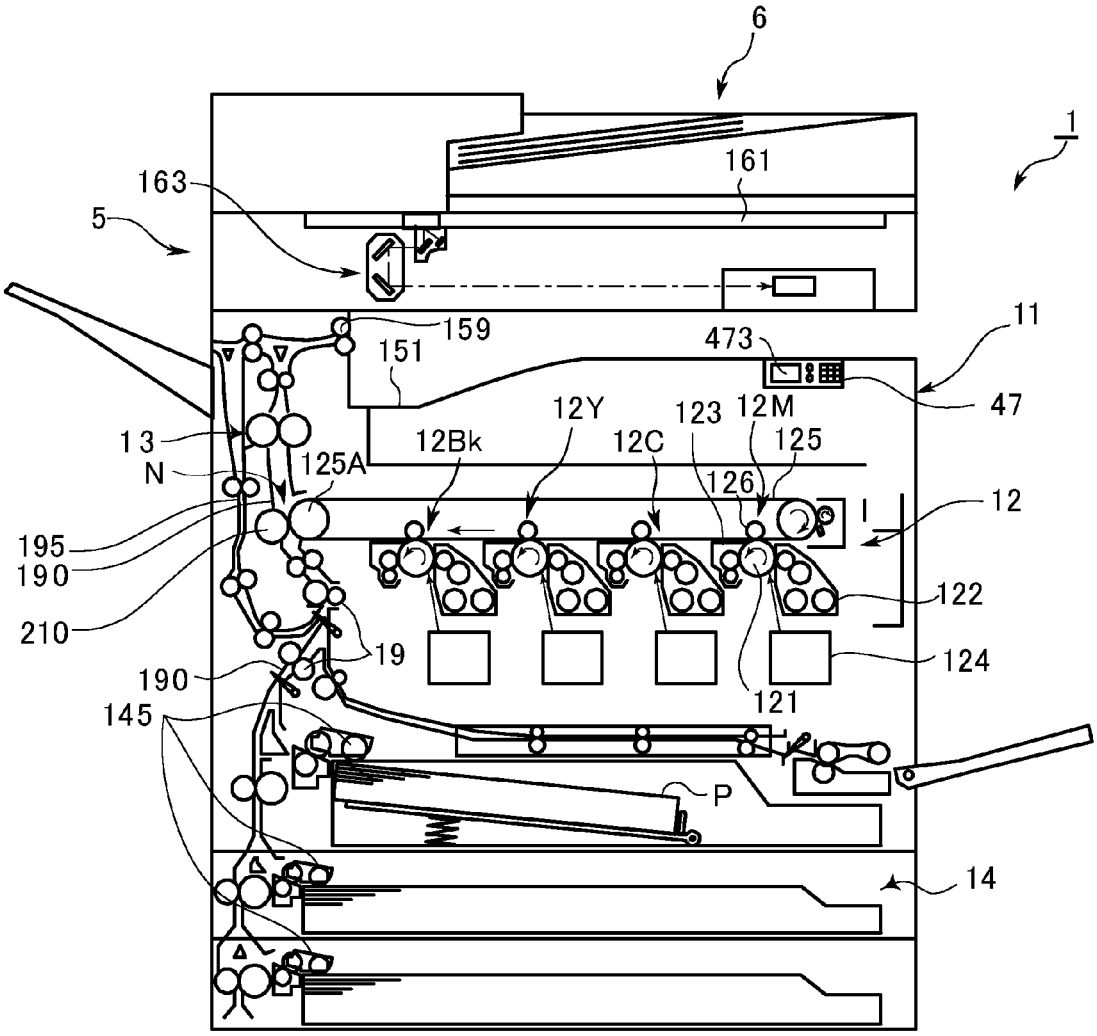
FIG. 1 is an elevational cross section showing a structure of an image forming apparatus having image forming units according to one embodiment of this disclosure.

Hereinafter, image forming units and an image forming apparatus provided with such image forming units according to one embodiment of this disclosure will be described with reference to the drawings. FIG. 1 is an elevational cross section showing a structure of the image forming apparatus having the image forming units according to one embodiment of this disclosure.

The image forming apparatus 1 according to one embodiment of this disclosure is a multifunction peripheral combining a plurality of functions such as, for example, a copy function, a printer function, a scanner function, and a facsimile function. The image forming apparatus 1 includes: in an apparatus main body 11, an operation section 47, an image formation section 12, a fixing section 13, a paper feed section 14, a document feed section 6, a document reading section 5, etc.

The operation section 47 receives, from an operator for various kinds of operation and processing executable by the image forming apparatus 1, instructions such as an image formation operation execution instruction and a document reading operation execution instruction. The operation section 47 includes a display section 473 which displays, for example, an operation guide to the operator.

To perform the document reading operation by the image forming apparatus 1, an image of a document fed by the document feed section 6 or a document loaded on document loading glass 161 is optically read by the document reading section 5 to generate image data. The image data generated by the document reading section 5 is saved into, for example, a built-in HDD or a network-connected computer.

To perform the image formation operation by the image forming apparatus 1, based on, for example, the image data generated through the document reading operation, the image data received from the network-connected computer, or the image data stored in the built-in HDD, the image formation section 12 forms a toner image on recording paper P as a recording medium fed from the paper feed section 14.

A magenta image forming unit 12M, a cyan image forming unit 12C, an yellow image forming unit 12Y, and a black image forming unit 12B of the image formation section 12 each include: a photoconductive drum 121, a developing device 122, a charging device 123, an exposure device 124, and a primary transfer roller 126.

To perform color printing, each of the magenta image forming unit 12M, the cyan image forming unit 12C, the yellow image forming unit 12Y, and the black image forming unit 12Bk of the image formation section 12, based on an image formed of a respective color component forming the image data, forms a toner image onto the photoconductive drum 121 through charging, exposure, and development processes, and transfers the toner image onto an intermediate transfer belt 125 by the primary transfer roller 126.

The toner images of the respective colors transferred onto the intermediate transfer belt 125 are superposed on one another on the intermediate transfer belt 125 through transfer timing adjustment, turning into a color toner image. A secondary transfer roller 210 transfers, at a nip part N formed between the secondary transfer roller 210 and a driving roller 125A with the intermediate transfer belt 125 in between, the color toner image, which has been formed on a surface of the intermediate transfer belt 125, onto recording paper P conveyed through a conveyance path 190 from the paper feed section 14. Then the fixing section 13 fixes the toner image on the recording paper P thereon through thermal compression. The recording paper P on which the color toner image has already been formed and which has gone through fixing processing is discharged onto a discharge tray 151.

The paper feed section 14 includes a plurality of paper feed cassettes. A control section (not shown) drives, into rotation, a pickup roller 145 of the paper feed cassette storing recording paper of a size specified by an operator's instruction to convey the recording paper P stored in the respective paper feed cassette towards the nip part N.

In the image forming apparatus 1, to perform double face printing, the recording paper P on one side of which the image has been formed by the image formation section 12 is nipped with a discharge roller pair 159, is then switched back by the discharge roller pair 159 and conveyed to an inverted conveyance path 195, and is conveyed again by a conveyance roller pair 19 to a region upstream of the nip part N and the fixing section 13 in a direction in which the recording paper P is conveyed. As a result, an image is formed on another surface of the recording paper by the image formation section 12.

Next, mechanisms around the photoconductive drums 121 and the charging devices 123 in the image forming units 12M, 12C, 12Y, and 12Bk will be described. The mechanisms around the photoconductive drums 121 and the charging devices 123 in the image forming units 12M, 12C, 12Y, and 12Bk are identical, and thus in the following description, the color of the image forming unit is not specified and numeral 12 will be provided for the description.

Figure 2:
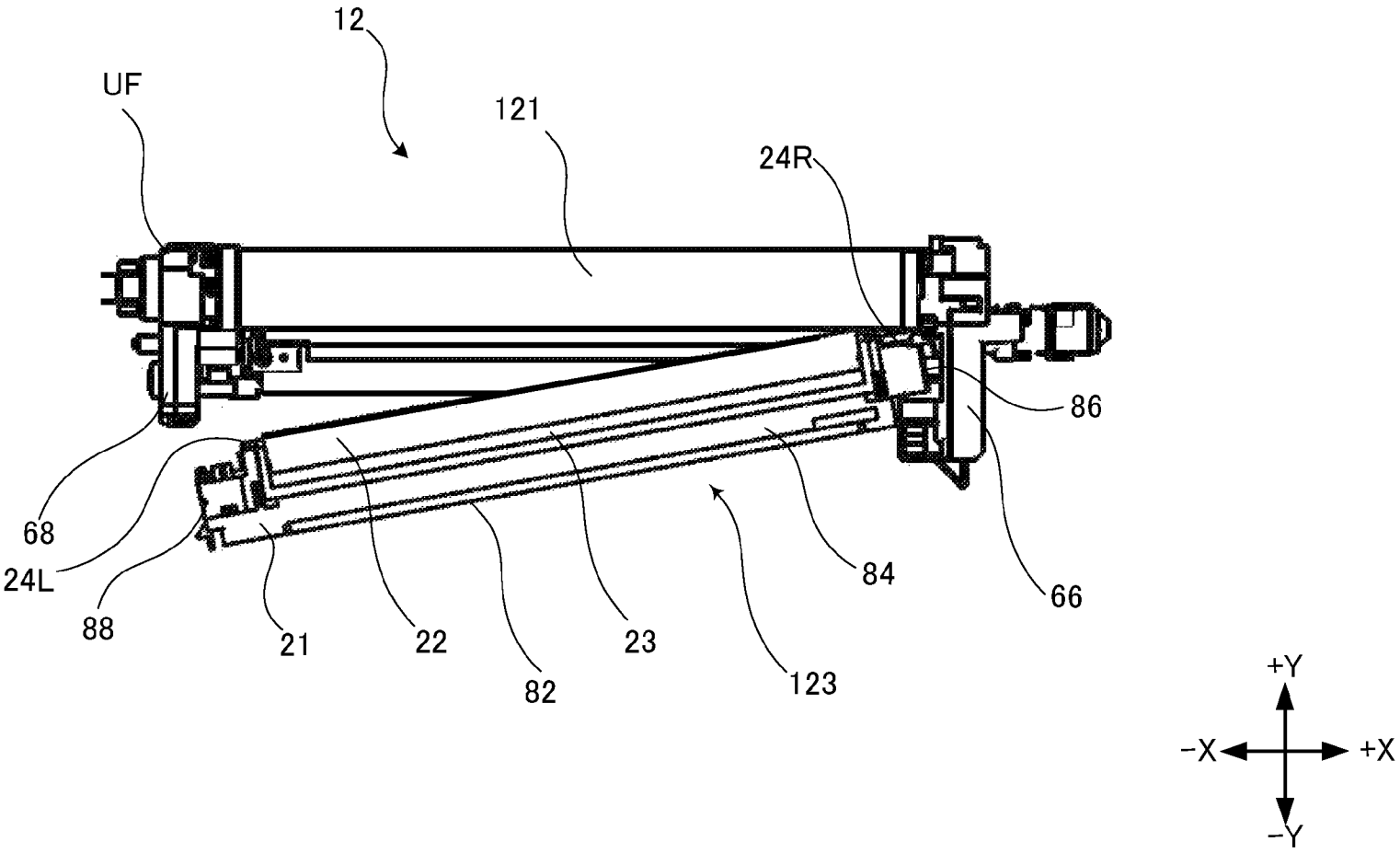
FIG. 2 is a side view showing a state in which a charging device is fitted to a unit frame in the image forming unit.

FIG. 2 is a side view showing a state in which the charging device 123 is fitted to a unit frame UF in the image forming unit 12. In FIG. 2, a direction (X-X direction) along a rotary shaft of the photoconductive drum 121 is defined as a horizontal direction and a radial direction (Y-Y direction) orthogonal to this direction along the rotary shaft is defined as a vertical direction, and, in particular, an −X direction is defined as left, an +X direction is defined as right, a −Y direction is defined as bottom, and a +Y direction is defined as top.

FIG. 2 shows the state in which the charging device 123 is fitted to the unit frame UF, and in a state after the charging device 123 is fitted to the unit frame UF, while held at the unit frame UF with bearing members 24R and 24L in between, the charging roller 22 is arranged in parallel to the photoconductive drum 121 in contact with a circumferential surface of the photoconductive drum 121 with their rotary shafts in parallel to each other.

The image formation unit 12 is provided with the unit frame UF including a pair of side walls 66 and 68 opposing each other with a gap in between. To this unit frame UF, the photoconductive drum 121 and the charging device 123 are detachably attached. The photoconductive drum 121 is rotationally and pivotably supported between the side walls 66 and 68. The unit frame UF is one example of a frame member in the scope of the claims.

Figure 3:
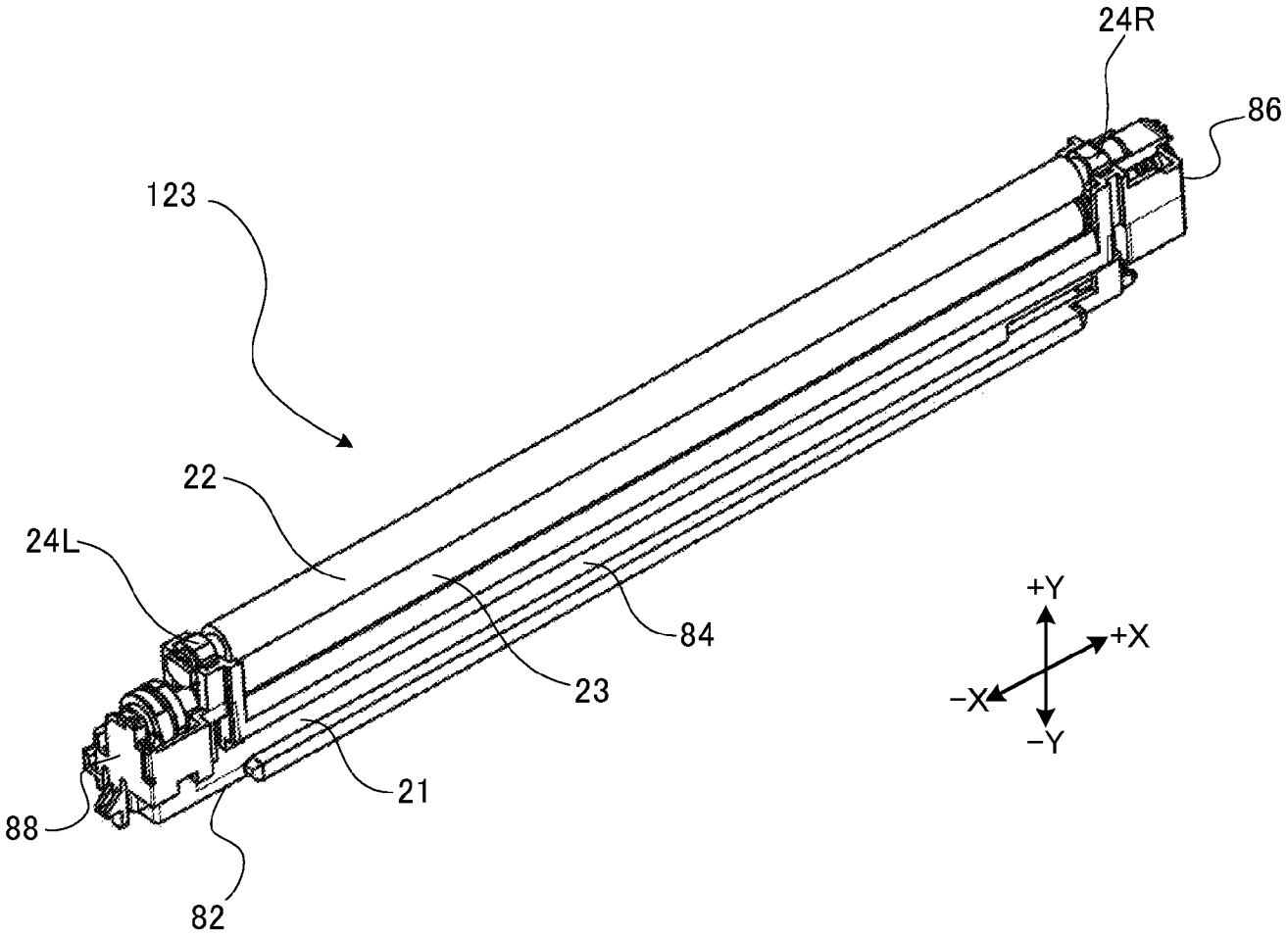
FIG. 3 is a perspective view showing the charging device.

FIG. 3 is a perspective view showing this charging device 123. In FIG. 3, a direction (X-X direction) along rotary shafts of the charging roller 22 and a cleaning roller 23 is defined as a horizontal direction and a radial direction (Y-Y direction) orthogonal to this direction along the rotary shafts is defined as a vertical direction, and, in particular, an −X direction is defined as left, an +X direction is defined as right, a −Y direction is defined as bottom, and a +Y direction is defined as top.

The charging device 123 includes: a charging case 21, the charging roller 22, the cleaning roller 23, and bearing members 24L and 24R. In the following, unless the bearing members 24L and 24R need to be discriminated from each other for a description, the bearing members 24L and 24R are simply referred to as bearing members 24. The charging roller 22 is one example of a charging member in the scope of the claims. The bearing member 24 is one example of a holding member in the scope of the claims.

The charging case 21 is formed of, for example, non-conductive synthetic resin, includes: a bottom wall 82 longitudinally extending in a slim form of a given width; side walls 84 extending upwardly (in the +Y direction) from both sides of the bottom wall 82 in a manner such as to oppose each other; and a pair of end walls 86 and 88 extending upwardly (in the +Y direction) from both longitudinal ends of the bottom wall 82, and, as a whole, is formed into a box shape with a top (the +Y direction) open. Arranged inside of the charging case 21 are: the charging roller 22, the cleaning roller 23, and the bearing members 24.

The charging roller 22 is a roller which, in contact with the photoconductive drum 121, applies charging bias to a drum surface to charge the surface of the photoconductive drum 121. The charging roller 22 is formed by, for example, a conductive rubber layer. To the charging roller 22, the bias is applied from a charging bias application section, not shown.

The cleaning roller 23 is a roller which cleans the charging roller 22. The cleaning roller 23 is, for example, a sponge (foamed) roller. The cleaning roller 23 is arranged in a manner such as to abut the charging roller 22, and, for example, has a circumferential surface rotating in the same direction as that of a circumferential surface of the charging roller 22 with a circumferential speed difference therebetween, thereby removing a contaminant adhering to the circumferential surface of the charging roller 22.

The bearing members 24 are members which are formed of, for example, synthetic resin, and which pivotably support right and left end parts of the charging roller 22 and the cleaning roller 23. The bearing members 24L and 24R pivotably supporting these left and right end parts have a common basic structure but partially have different shapes. In this embodiment, only on the bearing member 24R, a projection 122 to be described later on is formed.

Figure 4:
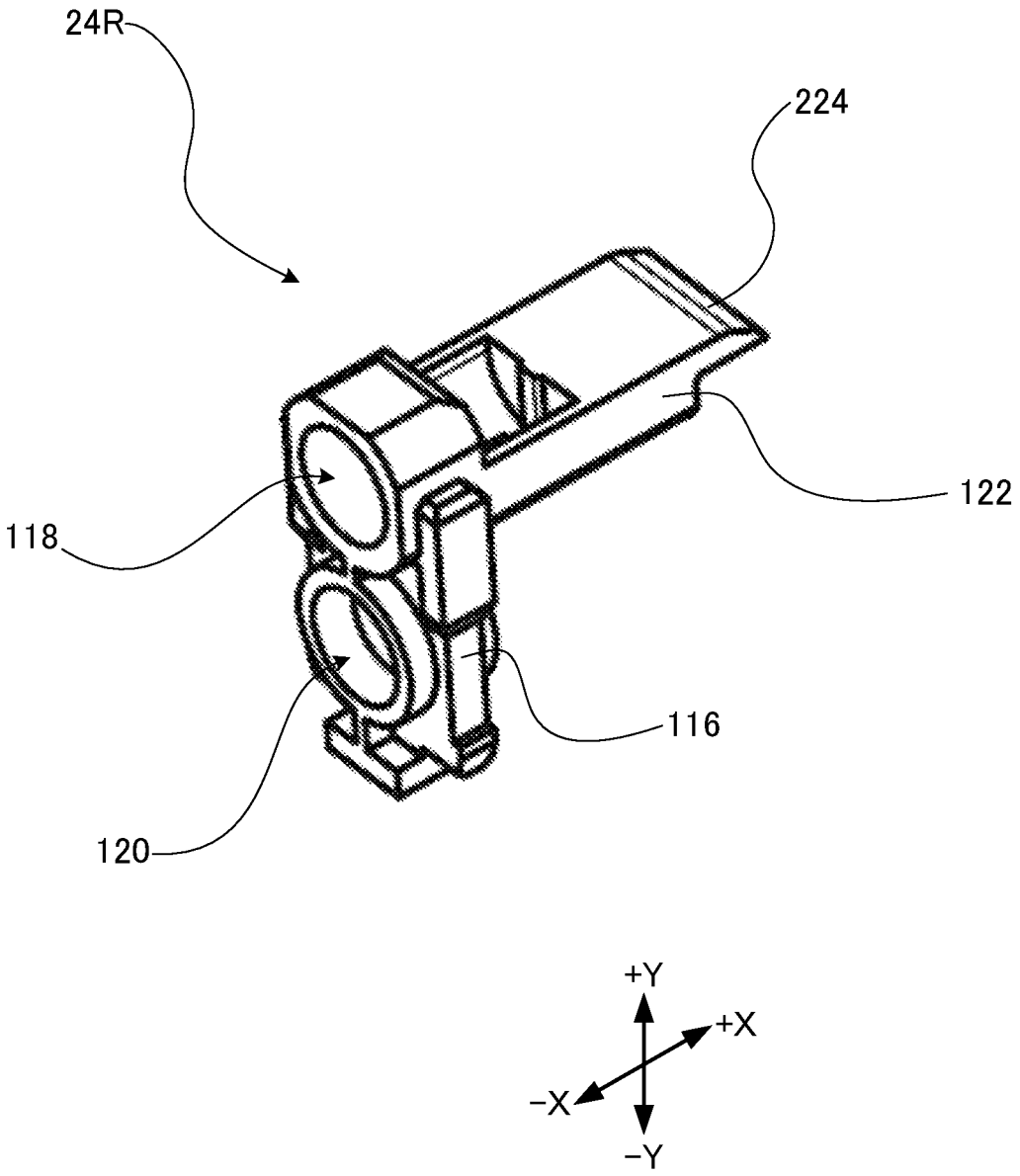
FIG. 4 is a perspective view showing a bearing member.

FIG. 4 is a perspective view showing the bearing member 24R. In FIG. 4, an axial direction (X-X direction) of the bearing member 24R is defined as a horizontal direction, a radial direction (Y-Y direction) orthogonal to this axial direction is defined as a vertical direction, and, in particular, an −X direction is defined as left, an +X direction is defined as right, a −Y direction is defined as bottom, and a +Y direction is defined as top.

The bearing member 24R includes: a main body part 116 in a form of a rectangular plate; and an upper bearing part 118 and a lower bearing part 120 respectively formed at an upper end part and a lower end part of this main body part 116.

The upper bearing part 118 rotationally and pivotably supports a rotary shaft of the charging roller 22. The upper bearing part 118 is one example of a bearing part in the scope of the claims. The lower bearing part 120 rotationally and pivotably supports a rotary shaft of the cleaning roller 23.

The upper bearing part 118 and the lower bearing part 120 are projected from both surfaces of the main body part 116 and extend in the horizontal direction (X-X direction). Formed on a right surface (one axial end surface) of the upper bearing part 118 is a projection 122 of a flanged shape protruding rightward (in the +X direction). This projection 122 is provided integrally with the upper bearing part 118. The projection 122, at an end part of the charging device 123 in the direction along the rotary shaft of the photoconductive drum 121, extends in this direction along the rotary shaft to support the charging device 123 at the unit frame UF.

A first tapered part 224 is formed at this projection 122. This first tapered part 224 has a shape whose vertical thickness (in the Y-Y direction) becomes increasingly smaller towards the right (in the +X direction), that is, towards the unit frame UF. Upon the fitting of the charging device 123 to the unit frame UF, the first tapered part 224 first makes contact with the unit frame UF. This prevents interference between the bearing member 24R and the photoconductive drum 121. To guide the charging device 123 to the unit frame UF while preventing this interference, it is preferable that a tip part of the projection 122 in a travel direction be increasingly thinner towards the unit frame UF. From this viewpoint, in this embodiment, the projection 122 is provided with the first tapered part 224 on its unit frame UF side. Moreover, the first tapered part 224 is formed at the projection 122 of the flanged shape protruding rightward (in the +X direction). Thus, in this embodiment, the first tapered part 224 can be brought into contact with the unit frame UF side earlier than the upper bearing part 118 upon the aforementioned fitting, which reliably prevent the interference between the bearing member 24R and the photoconductive drum 121.

Figure 5:
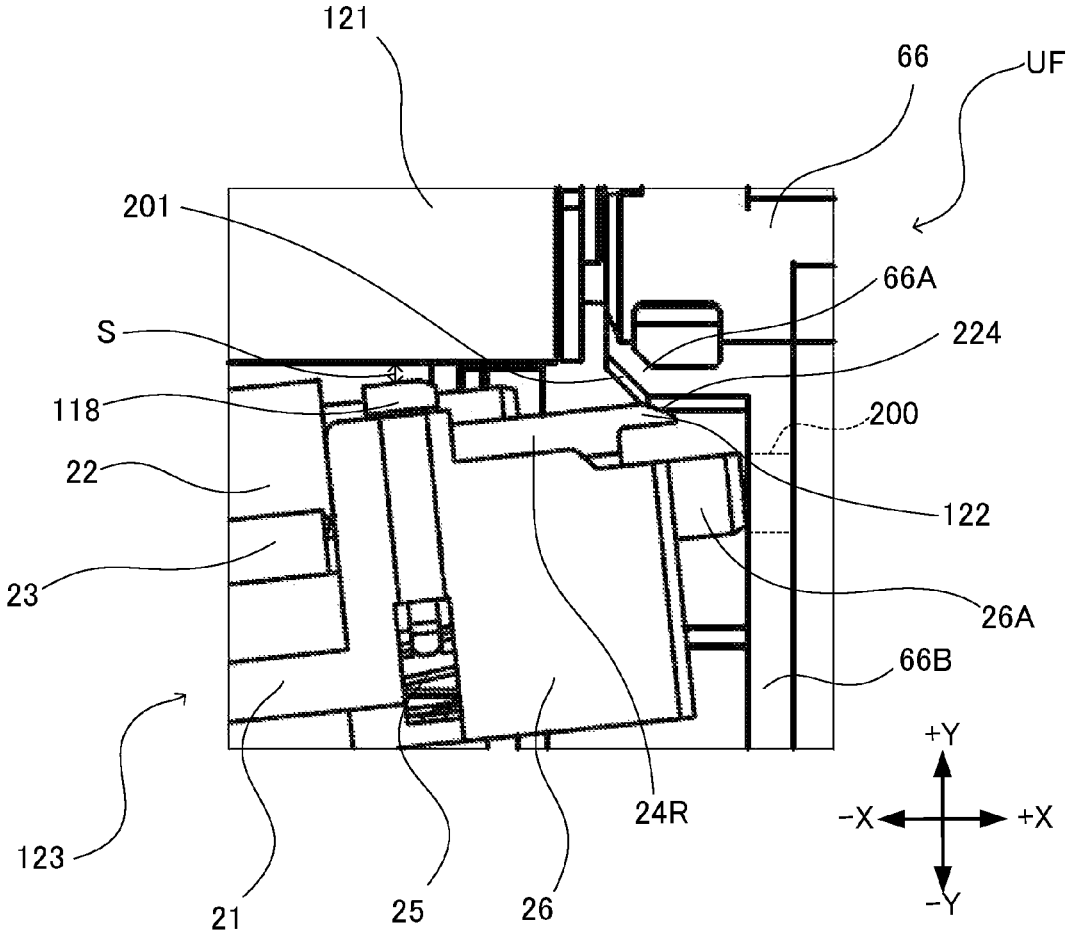
FIG. 5 is an enlarged view of mechanisms around the bearing member shown in FIG. 2.

FIG. 5 is an enlarged view of mechanisms around the bearing member 24 shown in FIG. 2. In FIG. 5, directions related to the photoconductive drum 121 are defined in the same manner as in FIG. 2. On the side wall 66 located below the photoconductive drum 121, side walls 66A and 66B are formed.

This side wall 66B is more recessed rightward (in an +X direction) than the side wall 66A. Formed at a bottom end part of the side wall 66A (in a −Y direction) is a second tapered part 201. This second tapered part 201 is slidable on the first tapered part 224. This second tapered part 201 has a shape with inclination such that its vertical thickness (in a Y-Y direction) becomes increasingly larger rightward (in the +X direction), that is, towards the side wall 66B. Upon the fitting of the charging device 123 to the unit frame UF, the projection 122 of the bearing member 24R first makes contact with the second tapered part 201. This prevents the interference between the bearing member 24R and the photoconductive drum 121. To smoothly guide the charging device 123 to the unit frame UF while preventing this interference, it is preferable that the side wall 66A to which the projection 122 travels in its travel direction have a shape whose thickness becomes increasingly larger towards the side wall 66B. From this viewpoint, in this embodiment, the side wall 66A is provided on its bearing member 24R side with the second tapered part 201. The first tapered part 224 and the second tapered part 201 are each one example of an interference-preventing shaped part in the scope of the claims.

The bearing member 24R is provided with a compression spring 25. The compression spring 25 is stored in a case body 26 together with the bearing member 24. This compression spring 25 is provided originally for the purpose of absorbing error in accuracy of positioning between the photoconductive drum 121 and the charging roller 22 upon fitting of the charging roller 22 and the cleaning roller 23 to the unit frame UF. This compression spring 25 is bent vertically (in the Y-Y direction) thereby moving the bearing member 24R vertically (in the Y-Y direction). Upon the fitting of the charging device 123 to the unit frame UF, contact between the first tapered part 224 of the projection 122 and the second tapered part 201 of the side wall 66A results in impact of the second tapered part 201 on the first tapered part 224, but this impact can be absorbed since the compression spring 25 is bent vertically (in the Y-Y direction) as described above.

Next, a mechanism of guiding the charging roller 22 to the unit frame UF by movement of the bearing member 24 upon the fitting of the charging roller 22 to the unit frame UF will be described.

In FIG. 5, upon the attachment of the charging roller 22 to the unit frame UF, a projection 26A of the case body 26 is inserted into a hole 200 on a unit frame UF side. In this state, the charging device 123 is inclined with respect to the photoconductive drum 121 with its left end part arranged lower (in the −Y direction) than its right end part, and thus it is arranged in a region lower than the photoconductive drum 121. In this state, the first tapered part 224 of the bearing member 24R first makes contact with the second tapered part 201 of the side wall 66A. That is, the projection 122 of the flanged shape projected rightward (outward) from the upper bearing part 118 first makes contact with the side wall 66A. Therefore, this can prevent the upper bearing part 118 from first making contact with the photoconductive drum 121. Furthermore, the first tapered part 224 slides on the second tapered part 201, and thus upon the fitting of the charging roller 22 to the unit frame UF, the charging roller 22 can smoothly be guided to the unit frame UF. That is, the inclination of the second tapered part 201, upon movement of the charging device 123 towards the unit frame UF while abutting the inclination of the first tapered part 224, guides the projection 26A to the hole 200.

Then a person in charge of the attachment arranges the charging roller 22 in contact with the circumferential surface of the photoconductive drum 121 at a position where rotary shafts of these two are aligned in parallel to each other.

In a state in which the charging roller 22 is guided in the aforementioned manner, between the circumferential surface of the photoconductive drum 121 and the bearing member 24, a vertical space S (in the Y-Y direction) is formed which can prevent the contact between them, preventing interference between the upper baring part 118 and the photoconductive drum 121. By the first tapered part 224 formed at the projection 122 and the second tapered part 201 formed on the side wall 66A, in the state in which the charging roller 22 is guided in the aforementioned manner, the bearing member 24 is guided to the unit frame UF in such a manner as to make the bearing member 24 escape from the photoconductive drum 121. The space S in FIG. 5 is one example of a space formed between the circumferential surface of the photoconductive drum 121 and the bearing member 24, and indicates a space formed between the circumferential surface of the photoconductive drum 121 and a top surface of the upper bearing part 118.

As described above, in this embodiment, in a state in which the charging roller 22 is guided in contact with the circumferential surface of the photoconductive drum 121 to the position where the rotary shafts of these two are aligned in parallel to each other, by the first tapered part 224 formed at the projection 122 and the second tapered part 201 formed on the side wall 66A, it can be guided to the unit frame UF in such a manner as to make the bearing member 24 escape from the photoconductive drum 121, which can therefore prevent the contact of the bearing member 24 with the surface of the photoconductive drum 121 upon the fitting of the charging device 123 to the unit frame UF.

A typical image forming apparatus faces a risk that, at time of fitting of a charge roller to a frame member, contact of a bearing pivotably supporting the charge roller with a circumferential surface of a photoconductive roller may damage this circumferential surface. Thus, an operator has to pay utmost attention to operation of fitting the charge roller to the frame member. On the contrary, in this embodiment, in a state in which the first tapered part 224 of the bearing member 24R slides on the second tapered part 201 of the side wall 66A, the radial space S capable of preventing the contact between the photoconductive drum 121 and the bearing member 24R is formed between them, and thus by the first tapered part 224 formed at the projection 122 and the second tapered part 201 formed on the side wall 66A, the operator can fit the charging device 123 to the unit frame UF without bringing the bearing member 24 into contact with the circumferential surface of the photoconductive drum 121.

According to this embodiment, providing the tapered parts at the bearing member 24 and part of the side wall 66 of the unit frame UF can smoothly guide the bearing member 24 to the unit frame UF without preventing the movement of the bearing member 24 upon the fitting.

Therefore, this embodiment can reliably prevent the damage on the photoconductive drum upon the fitting of the charging member to the frame member at lower costs than conventional art.

Moreover, the configuration and processing shown in the embodiment above with reference to FIGS. 1 to 5 are just one embodiment of this disclosure, and thus configuration and processing of this disclosure are not limited them.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. An image forming unit comprising:

a photoconductive drum pivotably supported at a frame member;

a charging member extending in a direction along a rotary shaft of the photoconductive drum and charging a circumferential surface of the photoconductive drum while making contact with the circumferential surface; and a holding member being provided in the charging member and holding the charging member at the frame member, wherein, while held at the frame member with the holding member in between, the charging member is arranged in parallel to the photoconductive drum in contact with the circumferential surface of the photoconductive drum with a rotary shaft of the charging member and the rotary shaft of the photoconductive drum in parallel to each other, and the holding member and the frame member respectively have interference-preventing-shaped parts being provided at a tip part of the holding member in a direction in which the holding member is attached and at a position of the frame member receiving the holding member, the interference-preventing-shaped parts being capable of first making contact with each other upon attachment of the charging member to the frame member with the holding member in between to thereby prevent interference between the holding member and the photoconductive drum.

2. The image forming unit according to claim 1, wherein the interference-preventing shaped parts include a first tapered part having the tip part formed by one end surface of the holding member in the direction along the rotary shaft, the holding member being extended in the direction along the rotary shaft, and further having an inclination such that a radial thickness orthogonal to the direction along the rotary shaft becomes increasingly smaller towards outside in the direction along the rotary shaft.

3. The image forming unit according to claim 2, wherein the first tapered part is formed at a projection of a flanged shape protruding outward from the one end surface of the holding member in the direction along the rotary shaft.

4. The image forming unit according to claim 1, wherein the interference-preventing shaped parts include a second tapered part being formed at the frame member and having an inclination such that a radial thickness orthogonal to the direction along the rotary shaft becomes increasingly larger towards the outside of the photoconductive drum in the direction along the rotary shaft.

5. The image forming unit according to claim 4, wherein the charging member has an end part in the direction along the rotary shaft provided with a projection extending in the direction along the rotary shaft for supporting the charging member at the frame member, the frame member is formed with a hole for receiving the projection, the inclination of the second tapered part is shaped in a manner such as to be capable of abutting the inclination of the first tapered part, and the inclination of the second tapered part guides the projection to the hole by movement of the charging member towards the frame member while the inclinations abut each other.

6. The image forming unit according to claim 5, wherein the first tapered part of the holding member is arranged between the projection part and an uppermost part of the charging member at the end part of the charging member in the direction along the rotary shaft.

7. The image forming unit according to claim 1, wherein the charging member is a charging roller, and the holding member has a bearing part pivotably supporting the charging roller.

8. An image forming apparatus comprising:

the image forming unit according to claim 1, and a fixing part fixing a toner image, which has been transferred onto recording medium by the image forming unit, on the recording medium.

* * * * *